United States Patent [19]

Morvai

[11] 4,023,388

[45] May 17, 1977

[54] LOCK COVER DEVICE

[75] Inventor: Gabor Morvai, Mount Royal, Canada

[73] Assignee: Dominion Lock Company Ltd., Montreal, Canada

[22] Filed: Aug. 9, 1976

[21] Appl. No.: 712,547

[52] U.S. Cl. ..... 70/455
[51] Int. Cl.[2] ..... E05B 17/18
[58] Field of Search ..... 70/54–56, 70/455; 16/DIG. 13, 140; 150/52 K, 52 L

[56] References Cited

UNITED STATES PATENTS

| | | | |
|---|---|---|---|
| 1,648,726 | 11/1927 | English | 70/455 |
| 1,982,956 | 12/1934 | Jacobi | 70/455 |
| 2,096,568 | 10/1937 | Snively | 70/455 |
| 2,782,625 | 2/1957 | Williams | 70/455 |

FOREIGN PATENTS OR APPLICATIONS

| | | | |
|---|---|---|---|
| 2,230,514 | 1/1974 | Germany | 16/DIG. 13 |

*Primary Examiner*—Robert L. Wolfe
*Attorney, Agent, or Firm*—Mark T. Basseches; Paula T. Basseches

[57] ABSTRACT

The present invention relates to a lock cover device particularly intended for use with so-called mortise locks. The device is fabricated of resilient polymeric material which may be readily mounted over the mortise lock, normally without the requirement for completely removing the lock from its mounted position and is characterized by the incorporation of a movable shutter member selectively shiftable between a stable sealing position and a stable keyway exposing position, the assembly including resilient cam and follower means for selectively biasing the shutter to one or the other of said stable positions, the shutter being preferably unstable at any intermediate position.

3 Claims, 5 Drawing Figures

LOCK COVER DEVICE

BACKGROUND OF THE INVENTION

1. Field of the Invention

The present invention is in the field of security devices, and more particularly relates to a lock cover device for protecting a mortise lock or the like against the ingress of moisture, detritus and the like.

2. The Prior Art

Numerous devices have been devised which are intended to function to protect locks against contamination while providing ready access to the keyway when the lock must be operated.

Such devices have, in general taken the form of more or less complex internal mechanical elements disposed within the lock housing per se and operable by manual movement or, in some instances, by insertion of a key into the keyway. Devices of the type described are fabricated as part of the lock mechanism and, accordingly, are not adaptable for use with already mounted lock mechanisms.

More recently it has been proposed to provide auxiliary protective members which may be used in conjunction with locks not originally equipped therewith. The members heretofore available have been cumbersome, unsightly and difficult to install.

SUMMARY OF THE INVNETION

With the foregoing in mind, the present invention may be summarized as directed to an improved lock shield or covering device characterized by the provision of a cover member mountable over the head of a mortise lock and pivotally carrying a shutter member movable relative to the cover. The shutter member and cover include a hinged connection, the assembly being made of resiliently deformable polymeric material. The construction of the hinge assembly is such that the shutter is stable in two fixed positions relative to the cover, i.e. a keyway sealing position in which the keyway is blocked by the shutter, and a fully open, keyway exposing position at which the shutter is cleared from the keyway.

It is accordingly an object of the present invention to provide an inexpensive lock cover device which is readily adaptable for use with mortise locks.

A further object of the invention is the provision of a cover device of the type described which may be made of resilient polymeric material.

Still a further object of the invention is the provision of a device of the type described which is comprised of two separate parts, notably a cover or housing adapted to be clampingly retained over the head of the lock, and a shutter member selectively shiftable between a closed or keyway blocking position and an open or keyway exposing position, the shutter being stable at the two noted positions but preferably being unstable at any intermediate position.

Still a further object of the invention is the provision of a lock cover assembly of the type described which includes an improved hinging assembly which simultaneously enables pivotal movement between the shutter and cover or housing and, in addition, functions to maintain the shutter and cover in one of the two noted stable positions, the resilient biasing action in particular maintaining a tight seal in the keyway covering position.

To attain these objects and such further objects as may appear herein or be hereinafter pointed out, reference is made to the accompanying drawings, forming a part hereof, in which.

Figure 1:
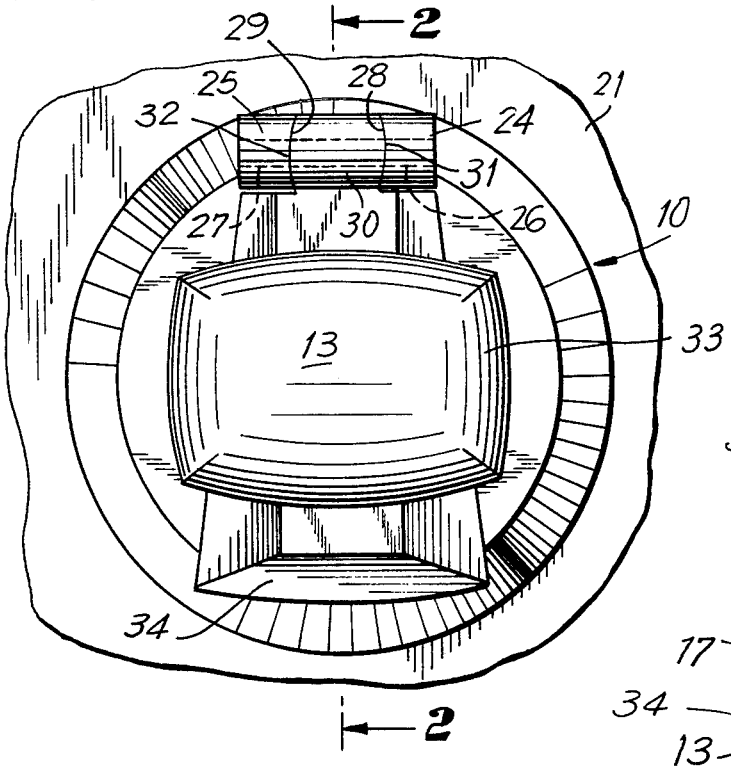
FIG. 1 is a front elevational view of a cover assembly in accordance with the invention mounted on a mortise lock.

Referring now to the drawings, there is shown in FIG. 1 a cover assembly 10 which is mounted over a lock 11 which may be of the mortise type, so called because it is installed by mortising the same into the body of a door, panel, drawer or the like. Locks of the type described may often be exposed to the weather, dust conditions, or like environmental factors which may, over a greater or lesser period of time, interfere with the proper operation of the unit.

If, for instance, moisture reaches the interior operating mechanism, e.g. tumbler pins or disks, and freezing conditions are encountered, the pins may be prevented from moving to their lock releasing position even with the use of a properly cut key. In circumstances where air borne dust and dirt are accessible to the interior of the lock, similar jamming often occurs.

The principal use of the instant device is in conjunction with already installed locks of the type described, the low cost of the item making it feasible for use as a give away or advertising premium.

The device of the present invention, which preferably is fabricated of a resilient polymeric material such as nylon or DELRIN, the trademark of DuPont Corporation, (long chain polyamides) includes a cover member or housing 12 and a shutter 13. The cover member 12 is generally frustoconic in configuration, including inclined side wall portions 14, a front face 15, and an inturned annular retainer flange 16. The front face 15 is provided with a through-going aperture 17, providing access to the keyway of the lock 11.

As shown, the lock 11 (a typical mortise lock being illustrated by way of example but without limitation) includes a cylindrical body portion 18, within which the lock mechanism is housed, and a frustoconic head 19 terminating in an enlarged base portion 20 which lies adjacent the panel, drawer or door 21 to which the lock is mounted.

As is well known, the body portion 18 typically includes an outer threaded portion 22, over the innermost end of which a locking nut (not shown) is threadedly connected. Normal tightening of the nut will draw the base portion 20 tightly against the front face of the panel 21.

The body portion 18 may be circular or cylindrical in transverse section but normally includes flat side portions (not shown) which prevent the rotation of the lock within the comparably shaped mounting aperture.

Figure 2:
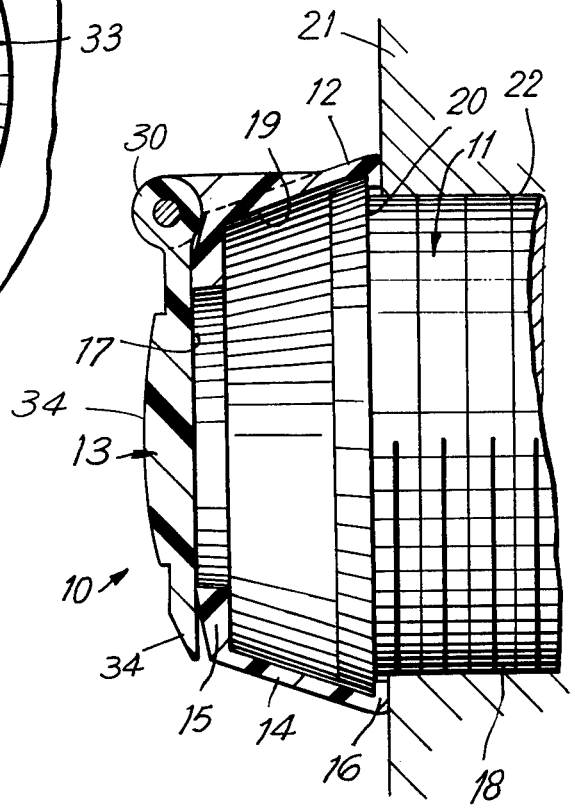
FIG. 2 is a vertical section taken on the line 2—2 of FIG. 1.

In order to mount the cover member 12 over an existing installed mortise lock, it is merely necessary to back off the locking nut described above and press the entire lock unit forwardly, providing a clearance space between the base 20 of the lock head and the front face of panel 21. With the parts thus positioned, the cover assembly 10 may be snapped into position by pressing the same in the direction of the panel 21, the inclined frustoconic head portion 19 of the lock functioning to cam the mounting flange 16 radially outwardly until the same passes beyond the head and snaps into position, as shown in FIG. 2.

The flange 16 may constitute a continuous annulus or may be comprised of a multiplicity of discrete arcuate segments which are together arrayed in an annulus. It will be understood that the latter construction is far easier to expand into position.

Mounting is completed by tightening the locking nut, whereupon the flange 16 is clamped between the front face of panel 21 and the base 20 of the lock head. It will be understood that other means for mounting the device may be employed.

The lock shutter 13 is secured to the cover 12 by a novel hinge structure next to be described. It is an important feature of the invention that the hinged connection between the shutter and cover or housing is such that the shutter is stable at the sealing position shown in FIG. 2 and preferably also at the keyway exposing position shown in dot and dash lines, FIG. 4, but is essentially unstable at any intermediate position, e.g. the solid line position of FIG. 4.

To this end the shutter plate 13 includes a hinge assembly, referred to generally at 23, which may include a pair of post members 24, 25 extending forwardly from the body of the cover 12, the post members being spaced apart and including coaxially aligned transverse apertures 26, 27.

Figure 3:
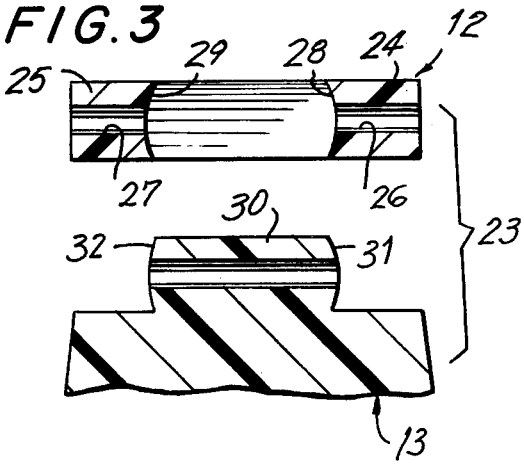
FIG. 3 is an exploded view showing details of the hinge assembly.

As best seen in FIGS. 1 and 3, the posts 24, 25 include inwardly facing wall portions 28, 29 which are generally concave.

The shutter plate 13 includes a central segment 30 which is disposed between the posts 24, 25, the lateral side faces 31, 32 of the segment being convex.

As seen in FIG. 1, the concave and convex faces of the posts and segment nest in the stable sealing position occupied by the parts in the condition of FIG. 1, at which position the shutter is lightly biased against the front plate of the housing. It will be readily recognized that any pivotal movement imparted to the plate 13, such as to the solid line position of FIG. 4, will result in a camming action wherein the posts 24, 25 are, in essence, spread laterally apart or stressed and the resilient material flattened —see, by way of example, the flattening diagrammatically illustrated in FIG. 5 as compared with the unstressed condition of the parts shown in FIG. 3.

Figure 4:
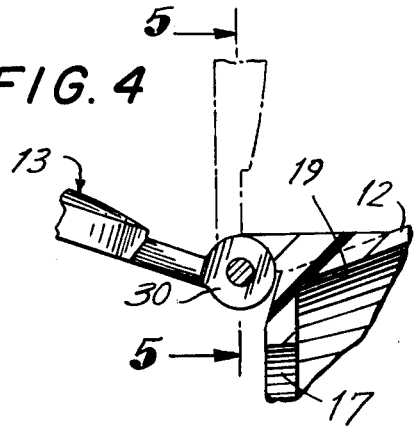
FIG. 4 is a sectional view showing the parts at an intermediate position.
Figure 5:
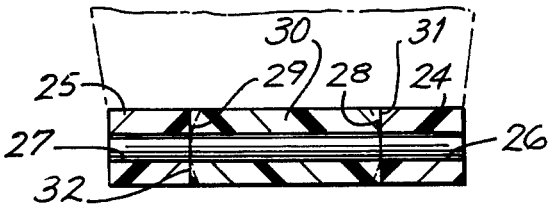
FIG. 5 is a section taken on the line 5—5 of FIG. 4.

It will also be observed that, due to the symmetry of the concave and convex surfaces described, after rotation through 180 °, the parts will be in their unstressed or minimum stressed condition in two positions, e.g. in the completely closed position depicted in FIG. 1 or the completely open position depicted in dot and dash lines, FIG. 4. At such stable positions, the concave and convex surfaces coact in the manner of detents.

If the shutter member is moved to virtually any intermediate position between the stable open and stable closed positions, e.g. the solid line position, FIG. 4, the energy stored in the spread posts will cause the concave and convex surfaces to coact and snap the shutter either to the open or closed position thereof, depending upon which of the noted positions the shutter more closely approaches when it is released.

While nylon and DELRIN form desirable plastic compositions, due to their resilience and their relatively low coefficient of friction, the invention is not to be considered as limited to the use of such materials.

The shutter device may incorporate an escutcheon or bezel 33 which is particularly suitable for carrying advertising materials. Desirably also, the front face of the shutter 13 may include a depending flange 34, providing a convenient gripping point for the fingers of the user to facilitate opening movements.

Optionally, the shutter plate and cover may include an auxiliary holding mechanism, such as a snap connection, provided for instance by complemental detents and detent seats, which connection will act as a positive latch for holding the shutter in the keyway blocking position.

It will be readily recognized that variations in configuration may be made without departing from the principles of the illustrated device. By way of example, in the illustrated embodiment the central segment has been disclosed as forming a part of the shutter plate whereas the surrounding posts are molded integrally with the cover. Obviously this arrangement of parts could be reversed, with the posts being molded to the shutter plate and the central segment forming a part of the cover.

Accordingly, the invention is to be broadly construed within the scope of the appended claims.

Having thus described the invention and illustrated its use, what is claimed as new and is desired to be secured by Letters Patent is:

1. A lock seal apparatus arranged to be mounted to a lock and selectively shiftable between a stable keyway sealing position and a keyway exposing position, comprising a resilient polymeric lock head cover member, said cover member including a front face portion having a circular access aperture adapted to register with the keyway of said lock, side wall portions, and an inturned rear mounting flange member in parallel spaced relation to said front face portion, said flange member being adapted to engage behind and support said cover against removal from said lock, a shutter member hingedly connected to said cover member shiftable between a sealing position in which a rear face of said shutter is engaged against said front face, and an exposing position in which said shutter is cleared from said front face, and hinge means interposed between said shutter member and said cover member, said hinge means including a pair of spaced parallel resilient upstanding posts extending from one said member, said posts including transversely directed, coaxially aligned apertures and opposed, inwardly facing, generally parallel wall portions, a central segment extending from the other said member disposed between said posts, said segment having outer side wall portions juxtaposed to said wall portions of said posts, said segment including a transverse aperture in coaxial alignment with the apertures of said posts, a hinge pin extending through said apertures of said posts and segment securing said segment to said posts for pivotal movement about said axis, and complemental cam and follower means formed on said posts and segment, said cam and follower means being positioned resiliently to deflect said posts responsive to relative movement of said segment and posts about said axis, said cam and follower portions, in the deflected condition thereof, urging said shutter toward one of said stable positions.

2. Apparatus in accordance with claim 1 wherein said cam and follower portions include first and second complemental detent means engaged, respectively, at said stable positions.

3. Apparatus in accordance with claim 2 wherein said inwardly facing walls of said posts are concave, and the side wall portions of said segment juxtaposed to said inner walls are convex, said concave and convex surfaces defining said detent means and being disposed in nested position at said stable positions and being substantially unstable at any intermediate position.

* * * * *